US010325558B2

(12) United States Patent
Choe et al.

(10) Patent No.: US 10,325,558 B2
(45) Date of Patent: Jun. 18, 2019

(54) DISPLAY APPARATUS AND METHOD OF DRIVING THE SAME

(71) Applicant: Samsung Display Co., Ltd., Yongin-Si, Gyeonggi-Do (KR)

(72) Inventors: Eungyeong Choe, Suwon-si (KR); Jin-wook Yang, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/865,965

(22) Filed: Jan. 9, 2018

(65) Prior Publication Data

US 2019/0043417 A1 Feb. 7, 2019

(30) Foreign Application Priority Data

Aug. 1, 2017 (KR) ..... 10-2017-0097826

(51) Int. Cl.
*G09G 3/325* (2016.01)
*G09G 3/36* (2006.01)
*G09G 3/20* (2006.01)

(52) U.S. Cl.
CPC ..... *G09G 3/325* (2013.01); *G09G 3/3607* (2013.01); *G09G 3/2074* (2013.01); *G09G 2320/028* (2013.01)

(58) Field of Classification Search
CPC ..... G09G 2320/0276; G09G 2320/066; G09G 2320/0673; G09G 2310/027
USPC ..... 345/690
See application file for complete search history.

(56) References Cited

U.S. PATENT DOCUMENTS

| | | | | |
|---|---|---|---|---|
| 8,760,386 | B2 | 6/2014 | An et al. | |
| 9,691,337 | B2 | 6/2017 | Kim et al. | |
| 2009/0058888 | A1* | 3/2009 | Chou | G09G 3/20 345/690 |
| 2011/0134152 | A1* | 6/2011 | Furihata | G09G 3/3648 345/690 |
| 2013/0083087 | A1* | 4/2013 | Byun | G09G 3/3233 345/690 |
| 2017/0092191 | A1* | 3/2017 | An | G09G 3/3233 |

FOREIGN PATENT DOCUMENTS

| | | | |
|---|---|---|---|
| KR | 1020100015135 | A | 2/2010 |
| KR | 1020150086983 | A | 7/2015 |
| KR | 101686103 | B1 | 12/2016 |

* cited by examiner

*Primary Examiner* — Koosha Sharifi-Tafreshi
(74) *Attorney, Agent, or Firm* — Cantor Colburn LLP

(57) ABSTRACT

A display apparatus includes a data processor generating gamma data. The data processor sequentially selects each of a plurality of pixels as a reference pixel, calculates difference values between a reference grayscale value provided to the reference pixel and comparison grayscale values provided to comparison pixels adjacent to the reference pixel, compares the difference values to a threshold value, counts up a value of a grayscale grade to which the reference grayscale value belongs among a plurality of grayscale grades according to the compared result, and varies the gamma data based on distribution ratios of values accumulated in the grayscale grades.

20 Claims, 12 Drawing Sheets

DISPLAY APPARATUS AND METHOD OF DRIVING THE SAME

This application claims priority to Korean Patent Application No. 10-2017-0097826, filed on Aug. 1, 2017, and all the benefits accruing therefrom under 35 U.S.C. § 119, the content of which in its entirety is herein incorporated by reference.

BACKGROUND

1. Field

Exemplary embodiments of the invention relate to a display apparatus and a method of driving the display apparatus.

2. Description of the Related Art

In general, a display apparatus includes a display panel including pixels to display an image, a gate driver applying gate signals to the pixels, a data driver applying data voltages to the pixels, and a timing controller controlling an operation of the gate driver and the data driver. The pixels receive the data voltages in response to the gate signals and display the image using the data voltages.

The timing controller receives image signals and converts a data format of the image signals to a data format appropriate to an interface between the data driver and the timing controller. The timing controller provides the image signals including the converted data format to the data driver as image data. The data driver receives the image data in digital form and gamma voltages in analog form. The data driver generates the data voltages corresponding to the image data using the gamma voltages and provides the data voltages to the pixels.

SUMMARY

Exemplary embodiments of the invention provide a display apparatus capable of improving a contrast ratio.

Exemplary embodiments of the invention provide a method of driving the display apparatus.

Exemplary embodiments of the invention provide a display apparatus including a plurality of pixels which receives a plurality of data voltages in response to a plurality of gate signals, a data processor which generates a plurality of gamma data, a gamma voltage generator which generates a plurality of gamma voltages using the plurality of gamma data, and a data driver which generates the plurality of data voltages using the gamma voltages and applies the plurality of data voltages to the plurality of pixels. The data processor sequentially selects each of the pixels as a reference pixel, calculates difference values between a reference grayscale value provided to the reference pixel and comparison grayscale values provided to comparison pixels adjacent to the reference pixel, compares the difference values to a threshold value, counts up a value of a grayscale grade to which the reference grayscale value belongs among a plurality of grayscale grades according to the compared result, and varies the plurality of gamma data based on distribution ratios of values accumulated in the plurality of grayscale grades.

The data processor includes a grayscale variation amount calculator which calculates the difference values between the reference grayscale value and the comparison grayscale values, a grayscale variation amount distribution analyzer which compares grayscale variation amounts defined by the difference values to the threshold value, compares the comparison grayscale values to a threshold range, and counts up the value of the grayscale grade to which the reference grayscale value belongs according to the compared result, a distribution ratio analyzer which calculates the distribution ratios of the values accumulated in the plurality of grayscale grades, and a gamma data modulator which varies the gamma data based on the distribution ratios of the values accumulated in the plurality of grayscale grades.

Exemplary embodiments of the invention provide a method of driving a display apparatus including sequentially selecting each of a plurality of pixels as a reference pixel to calculate difference values between a reference grayscale value provided to the reference pixel and comparison grayscale values provided to comparison pixels adjacent to the reference pixel, comparing the difference values to a threshold value and comparing the comparison grayscale values to a threshold range to count up a value of a grayscale grade to which the reference grayscale value belongs among a plurality of grayscale grades according to the compared result, calculating distribution ratios of values accumulated in the plurality of grayscale grades, varying a plurality of gamma data based on the distribution ratios of the values accumulated in the plurality of grayscale grades, generating a plurality of gamma voltages using the plurality of varied gamma data, and generating a plurality of data voltages using the gamma voltages to provide the plurality of data voltages to the plurality of pixels.

According to the above, the grayscale variation amounts between the pixels are calculated, the distribution ratio of the pixels in which the grayscale variation amounts are greater than the threshold value is calculated, and the gamma data vary depending on the distribution ratio to extend the gamma voltages. When the gamma voltages extend, the difference between the maximum brightness and the minimum brightness increases in the same grayscale range, and thus the contrast ratio of the display apparatus may be improved.

BRIEF DESCRIPTION OF THE DRAWINGS

The above and other advantages of the invention will become readily apparent by reference to the following detailed description when considered in conjunction with the accompanying drawings, in which.

DETAILED DESCRIPTION

Figure 1:
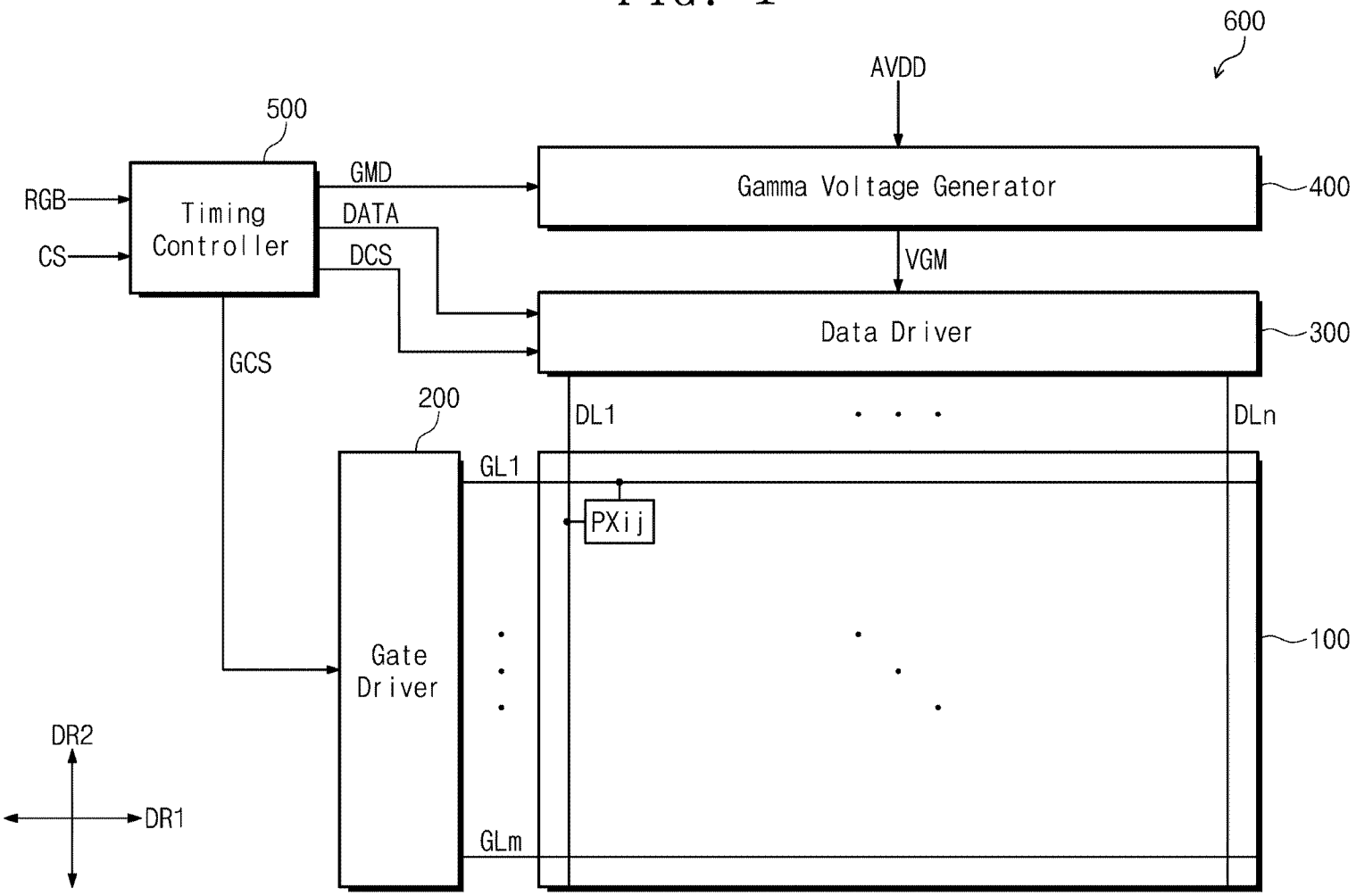
FIG. 1 is a block diagram showing a display apparatus according to an exemplary embodiment of the invention.

Features of the invention and methods of accomplishing the same may be understood more readily by reference to the following detailed description of preferred embodiments and the accompanying drawings. The invention may, however, be embodied in many different forms and should not be construed as being limited to the exemplary embodiments set forth herein. Rather, these embodiments are provided so that this invention will be through and complete and will fully convey the invention to those skilled in the art, and the invention will only be defined by the appended claims. Like reference numerals denote like elements throughout the specification.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the drawing figures. It will be understood that the spatially relative terms are intended to encompass different orientations of the device in use or operation in addition to the orientation depicted in the drawing figures. For example, if the device in the drawing figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Exemplary embodiments are described herein with reference to plan views and cross-sectional views that are schematic illustrations of idealized exemplary embodiments. As such, variations from the shapes of the illustrations as a result, for example, of manufacturing techniques and/or tolerances, are to be expected. Thus, exemplary embodiments should not be construed as limited to particular shapes of regions illustrated herein but are to include deviations in shapes that result, for example, from manufacturing. Thus the regions illustrated in the drawing figures are schematic in nature and their shapes are not intended to illustrate the actual shape of a region of a device and are not intended to limit the scope of the exemplary embodiments.

Hereinafter, the invention will be explained in detail with reference to the accompanying drawings.

FIG. 1 is a block diagram showing a display apparatus 600 according to an exemplary embodiment of the invention.

Referring to FIG. 1, the display apparatus 600 includes a display panel 100, a gate driver 200, a data driver 300, a gamma voltage generator 400, and a timing controller 500. In an exemplary embodiment, the display panel 100 may be a liquid crystal display ("LCD") panel including a liquid crystal layer, for example, but the display panel 100 should not be limited to the LCD panel. In an exemplary embodiment, as the display panel 100, various panels, such as an electrophoretic display panel including an electrophoretic layer, an electrowetting display panel including an electrowetting layer, an organic light emitting display panel including an organic light emitting layer, etc., may be used, for example.

The display panel 100 includes a plurality of gate lines GL1 to GLm, a plurality of data lines DL1 to DLn, and a plurality of pixels PX. Here, each of m and n is a natural number. The gate lines GL1 to GLm and the data lines DL1 to DLn are insulated from each other while crossing each other. The gate lines GL1 to GLm extend in a first direction DR1 and are connected to the gate driver 200. The data lines DL1 to DLn extend in a second direction DR2 and are connected to the data driver 300.

The pixels PX are arranged in areas defined by the gate lines GL1 to GLm and the data lines DL1 to DLn crossing the gate lines GL1 to GLm. The pixels PX are arranged in a matrix form and connected to the gate lines GL1 to GLm and the data lines DL1 to DLn. However, the invention is not limited thereto, and the pixels PX may be arranged in various other forms. Each of the pixels PX may display one of primary colors. In an exemplary embodiment, the primary colors may include a red color, a green color, a blue color, and a white color, for example, but the primary colors should not be limited thereto or thereby. In an exemplary embodiment, the primary colors may further include a yellow color, a cyan color, a magenta color, etc., for example.

The timing controller 500 receives a plurality of image signals RGB to display the image and control signals CS to control an operation of the gate driver 200 and the data driver 300 from an external source (e.g., a system board). In an exemplary embodiment, the image signals RGB may include red, green, and blue image signals, for example. In an exemplary embodiment, the control signals CS may include a vertical synchronization signal as a frame distinction signal, a horizontal synchronization signal as a row distinction signal, a data enable signal maintained at a high level during a period, in which data are output, to indicate a data input period, and a main clock signal, for example.

The timing controller 500 converts a data format of the image signals RGB to a data format appropriate to an interface between the data driver 300 and the timing controller 500. The timing controller 500 provides the image signals RGB including converted data format to the data driver 300 as the image data DATA.

The timing controller 500 generates a gate control signal GCS and a data control signal DCS in response to the control signals CS. The gate control signal GCS is provided to the gate driver 200 as a control signal to control an operation timing of the gate driver 200. The data control signal DCS is provided to the data driver 300 as a control signal to control an operation timing of the data driver 300.

The gate driver 200 receives the gate control signal GCS from the timing controller 500 and generates a plurality of gate signals in response to the gate control signal GCS. The gate signals are sequentially output from the gate driver 200 and provided to the pixels PX arranged in the unit of row through the gate lines GL1 to GLm.

The data driver 300 receives the image data DATA and the data control signal DCS from the timing controller 500 and gamma voltages VGM from the gamma voltage generator 400. The data driver 300 generates and outputs data voltages in analog form, which correspond to the image data DATA, in response to the data control signal DCS. The data driver 300 may generate the data voltages using the gamma voltages VGM, and the data voltages may be provided to the pixels PX through the data lines DL1 to DLn.

The timing controller 500 generates gamma data GMD on the basis of grayscale values of the image signals RGB. The gamma data GMD are data used to determine the gamma voltages corresponding to the grayscale values.

The gamma voltage generator 400 receives the gamma data GMD from the timing controller 500 and an analog voltage AVDD from a voltage generator (not shown). The gamma voltage generator 400 generates a plurality of gamma voltages VGM using the analog voltage AVDD and provides the gamma voltages VGM to the data driver 300. The gamma voltage generator 400 may generate the gamma voltages VGM based on the gamma data GMD when the gamma voltages VGM are generated.

The timing controller 500 analyzes an amount of variation of the image signals RGB applied to the pixels PX adjacent to each other and varies the gamma data GMD based on the analyzed result. A range of the gamma voltages VGM in analog form may extend by the varied gamma data GMD. Such operation will be described in detail later.

The pixels PX receive the data voltages in response to the gate signals. The pixels PX are driven by the data voltages to display the image.

Figure 2:
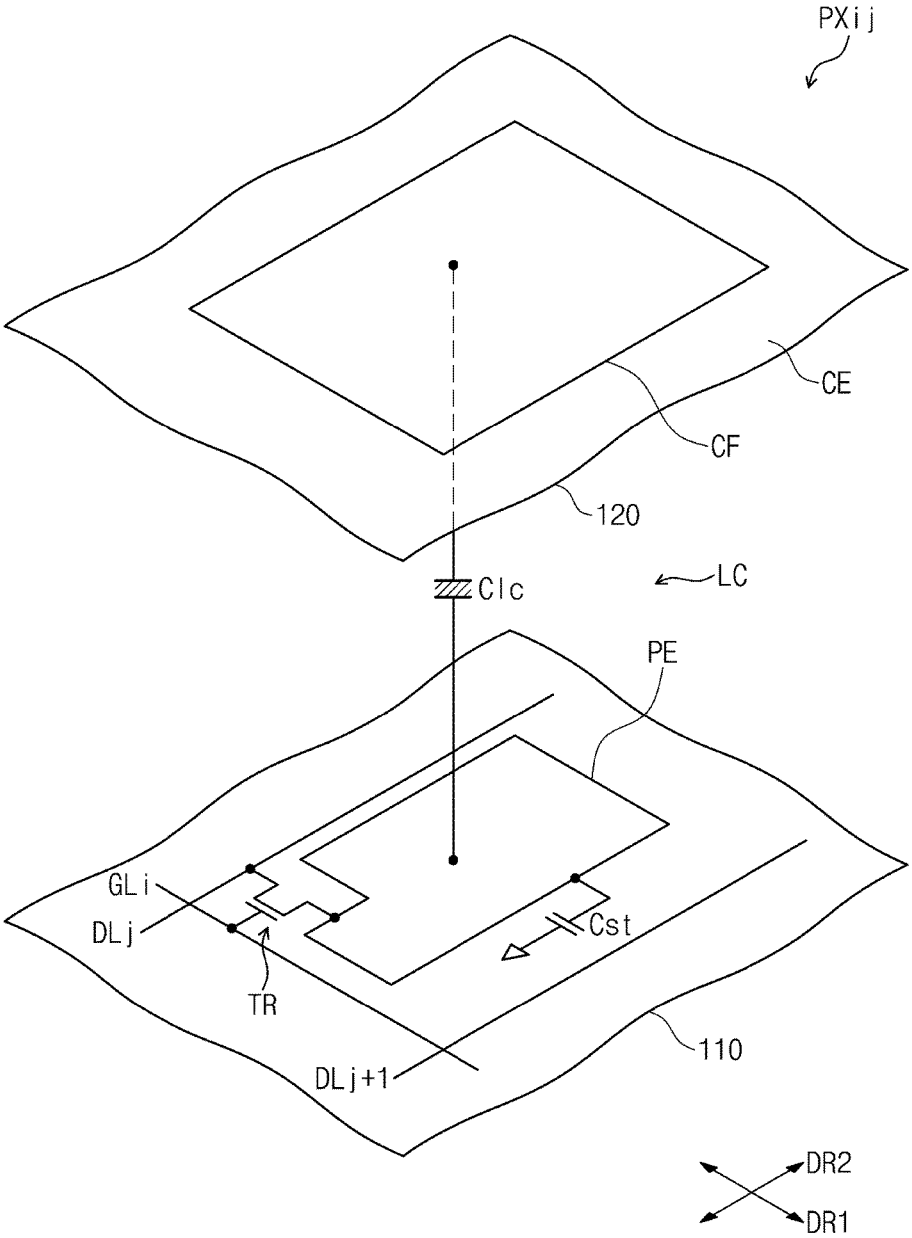
FIG. 2 is a perspective view showing a configuration of a pixel shown in FIG. 1.

FIG. 2 is a perspective view showing a configuration of a pixel shown in FIG. 1.

For the convenience of explanation, FIG. 2 shows a pixel PXij connected to a gate line GLi and a data line DLj, but other pixels PX of the display panel 100 may have the same structure and function as those of the pixel PXij shown in FIG. 2. Here, each of "i" and "j" is a natural number.

Referring to FIG. 2, the pixel PXij includes a transistor TR connected to the gate line GLi and the data line DLj, a liquid crystal capacitor Clc connected to the transistor TR, and a storage capacitor Cst connected to the liquid crystal capacitor Clc in parallel. In another exemplary embodiment, the storage capacitor Cst may be omitted. The transistor TR may be disposed on a first substrate 110. The transistor TR includes a gate electrode (not shown) connected to the gate line GLi, a source electrode (not shown) connected to the data line DLj, and a drain electrode (not shown) connected to the liquid crystal capacitor Clc and the storage capacitor Cst.

The liquid crystal capacitor Clc includes a pixel electrode PE disposed on the first substrate 110, a common electrode CE disposed on a second substrate 120, and the liquid crystal layer LC interposed between the pixel electrode PE and the common electrode CE. The liquid crystal layer LC serves as a dielectric substance. The pixel electrode PE is connected to the drain electrode of the transistor TR.

In FIG. 2, the pixel electrode PE has a non-slit structure, but it should not be limited thereto or thereby. That is, in another exemplary embodiment, the pixel electrode PE may have a slit structure defined by a trunk portion with a cross shape and a plurality of branch portions extending from the trunk portion in a radial direction. The common electrode CE may be disposed over the second substrate 120, but it should not be limited thereto or thereby. That is, in another exemplary embodiment, the common electrode CE may be disposed on the first substrate 110. In this case, slits may be defined in at least one of the pixel electrode PE and the common electrode CE.

The storage capacitor Cst may include the pixel electrode PE, a storage electrode (not shown) branched from a storage line (not shown), and an insulating layer disposed between the pixel electrode PE and the storage electrode. The storage line may be disposed on the first substrate 110 and substantially simultaneously formed with the gate lines GL1 to GLm in the same layer. The storage electrode may partially overlap with the pixel electrode PE.

The pixel PX may further include a color filter CF displaying one of red, green, and blue colors, for example. As an example, the color filter CF may be disposed on the second substrate 120 as shown in FIG. 2. However, in another exemplary embodiment, the color filter CF may be disposed on the first substrate 110.

The transistor TR is turned on in response to the gate signal provided thereto through the gate line GLi. The data voltage provided through the data line DLj is applied to the pixel electrode PE of the liquid crystal capacitor Clc through the turned-on transistor TR. The common electrode CE is applied with a common voltage.

An electric field is generated between the pixel electrode PE and the common electrode CE due to a difference in voltage level between the data voltage and the common voltage. Liquid crystal molecules of the liquid crystal layer LC are driven by the electric field generated between the pixel electrode PE and the common electrode CE. A light transmittance of the liquid crystal layer LC is controlled by the liquid crystal molecules driven by the electric field, and thus the desired image is displayed. Although not shown in drawing figures, a backlight unit may be disposed at a rear side of the display panel 100 to provide a light to the display panel 100. However, the invention is not limited thereto, and the backlight unit may be disposed at various other positions.

The storage line is applied with a storage voltage having a constant voltage level, but the storage line may be applied with the common voltage according to embodiments. The storage capacitor Cst compensates for a charge rate of the liquid crystal capacitor Clc.

Figure 3:
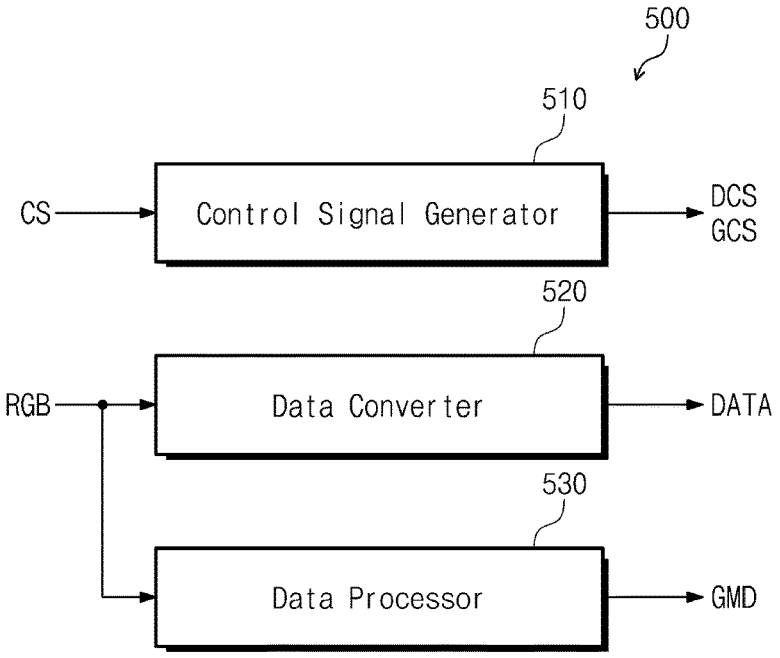
FIG. 3 is a block diagram showing a timing controller shown in FIG. 1.
Figure 4:
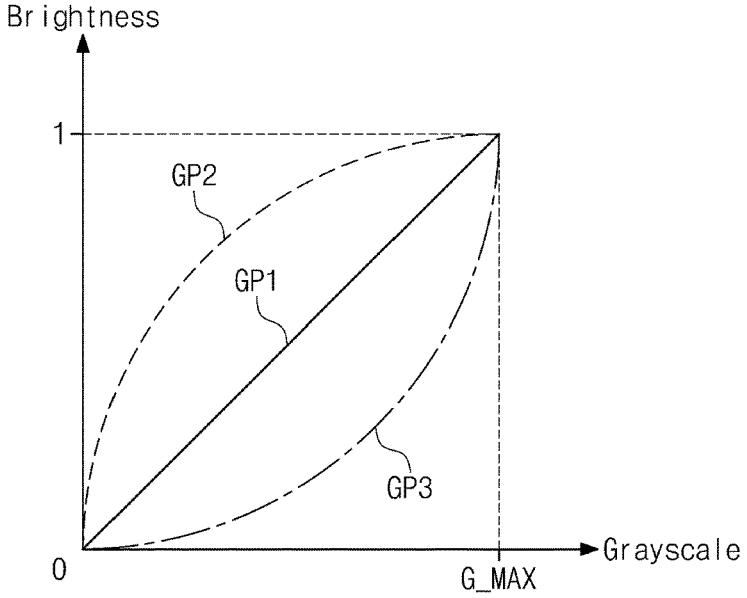
FIG. 4 is a view showing a gamma curve according to predetermined gamma data generated by a data processor shown in FIG. 3.

FIG. 3 is a block diagram showing the timing controller shown in FIG. 1. FIG. 4 is a view showing a gamma curve according to predetermined gamma data generated by a data processor shown in FIG. 3.

Referring to FIG. 3, the timing controller 500 includes a control signal generator 510, a data converter 520, and a data processor 530. The control signal generator 510 receives the control signals CS and generates the gate control signal GCS and the data control signal DCS in response to the control signals CS to output the gate control signal GCS and the data control signal DCS. The data converter 520 receives the image signals RGB and converts the image signals RGB to the image data DATA to output the image data DATA.

Referring to FIGS. 3 and 4, the data processor 530 generates and outputs the gamma data GMD based on the image signals RGB. Graphs shown in FIG. 4 indicate brightnesses corresponding to grayscale values of the image signals. A brightness value of 1 indicates that the brightness is 100%, and the brightnesses corresponding to 0 to a maximum grayscale value G_MAX are relatively represented.

Human eyes may differentiate a brightness difference depending on a variation of the grayscale values relatively well in a low grayscale, but the human eyes may differentiate the brightness difference depending on a variation of the grayscale values relatively poorly in a high grayscale. Although the grayscale values of the image signals RGB linearly increase as represented by a first graph GP1, the brightness recognized by the human eyes relatively rapidly increases in the low grayscale and gently increases in the high grayscale as represented by a second graph GP2 without linearly increasing, for example. The brightness that non-linearly varies may be compensated by a gamma curve like a third graph GP3 symmetric to the second graph GP2 to linearly vary the brightness variation, and thus the brightness variation becomes linear.

A relation between the grayscale values and the brightness may have the gamma curve as the third graph GP3 by the gamma voltages generated in the gamma voltage generator 400 using the gamma data GMD. The data processor 530 analyzes the amount of variation of the image signals RGB and controls the gamma curve using the analyzed result to increase a contrast ratio.

The data processor 530 sequentially set each pixel PX as a reference pixel PX and calculates a difference value between a reference grayscale value applied to the reference pixel PX and comparison grayscale values applied to comparison pixels PX defined by pixels PX disposed adjacent to the reference pixel PX, for example.

The data processor 530 classifies a grayscale range, which may be processed by the data driver 300, into a plurality of grayscale grades. The data processor 530 compares difference values between the reference grayscale value and the comparison grayscale values to a threshold value, compares the comparison grayscale values to a threshold range, and counts up the compared result to the grayscale grade to which the reference value belongs. The above-mentioned compared result is counted up and accumulated in the grayscale grades every reference pixel.

The data processor 530 calculates distribution ratios of the accumulated values in the grayscale grades and applies a weight to the grayscale grades in which the distribution ratio is greater than a threshold ratio among the grayscale grades. As the distribution ratio increases, the weight may increase. The data processor 530 may vary the gamma data using the weight such that the gamma data corresponding to the grayscale grades to which the weight is applied extend.

Since the gamma voltages VGM are generated by the gamma data GMD, a range of the gamma voltages VGM corresponding to the grayscale grades to which the weight is applied may extend in the case that the gamma data GMD extend. In the case that the range of the gamma voltages VGM extends, the range of the brightness extends, and thus the contrast ratio increases. The operation of the data processor 530 will be described in detail below.

Figure 5:
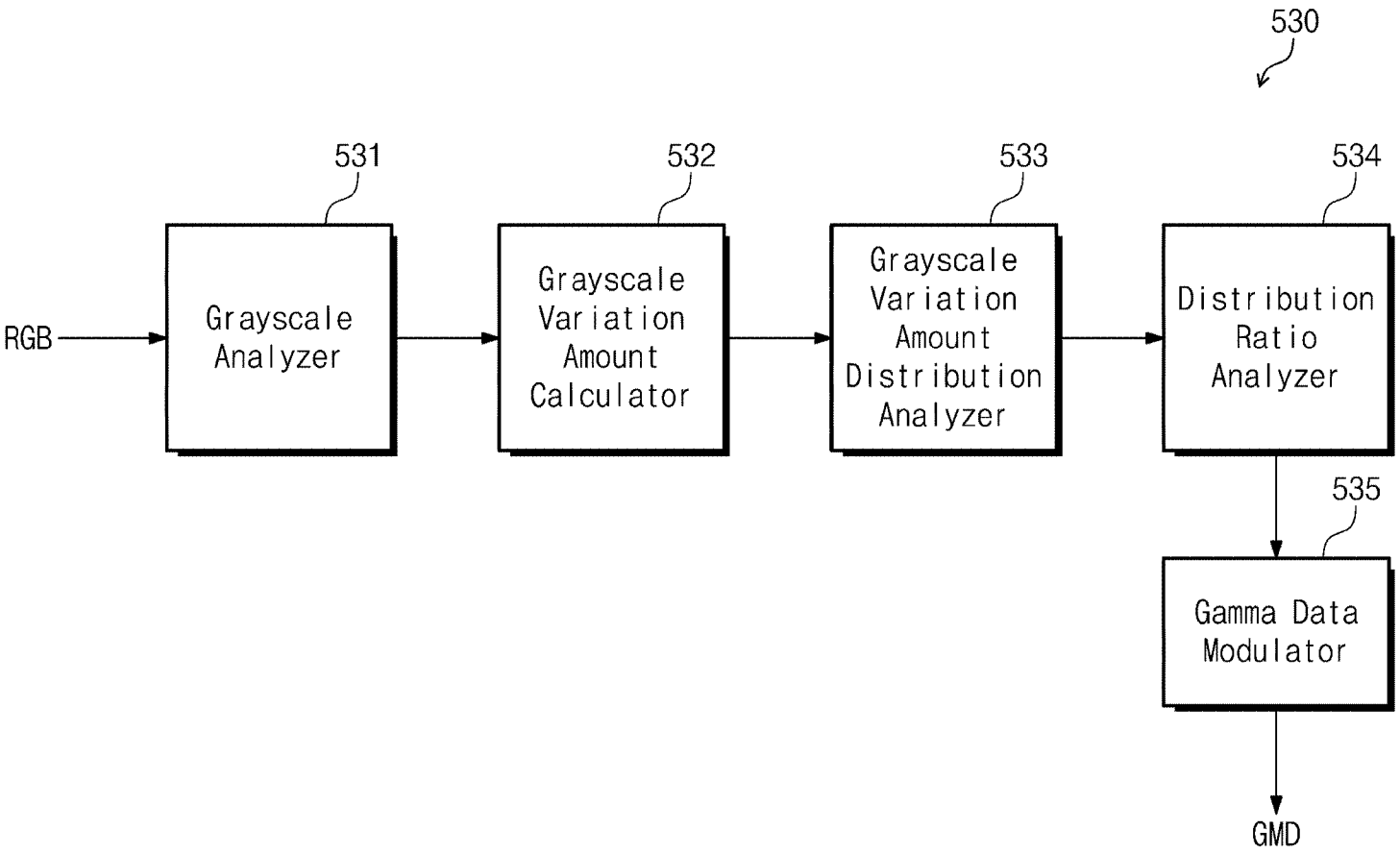
FIG. 5 is a block diagram showing a data processor shown in FIG. 3.
Figure 6:
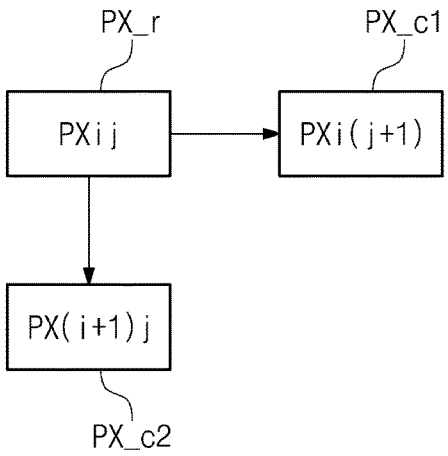
FIGS. 6 and 7 are views explaining an operation of a grayscale variation amount calculator shown in FIG. 5.
Figure 7:
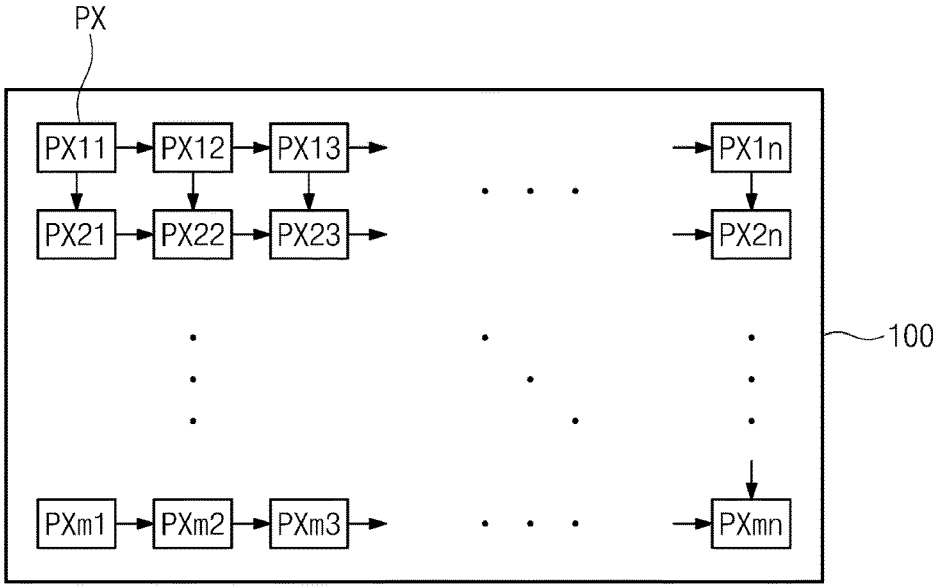
Figure 12:
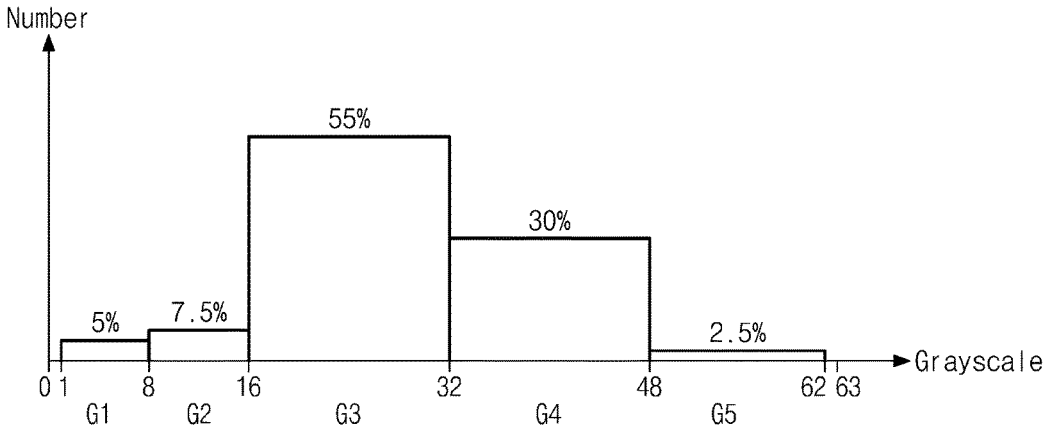
FIG. 12 is a view explaining an operation of a distribution ratio analyzer shown in FIG. 5.
Figure 13:
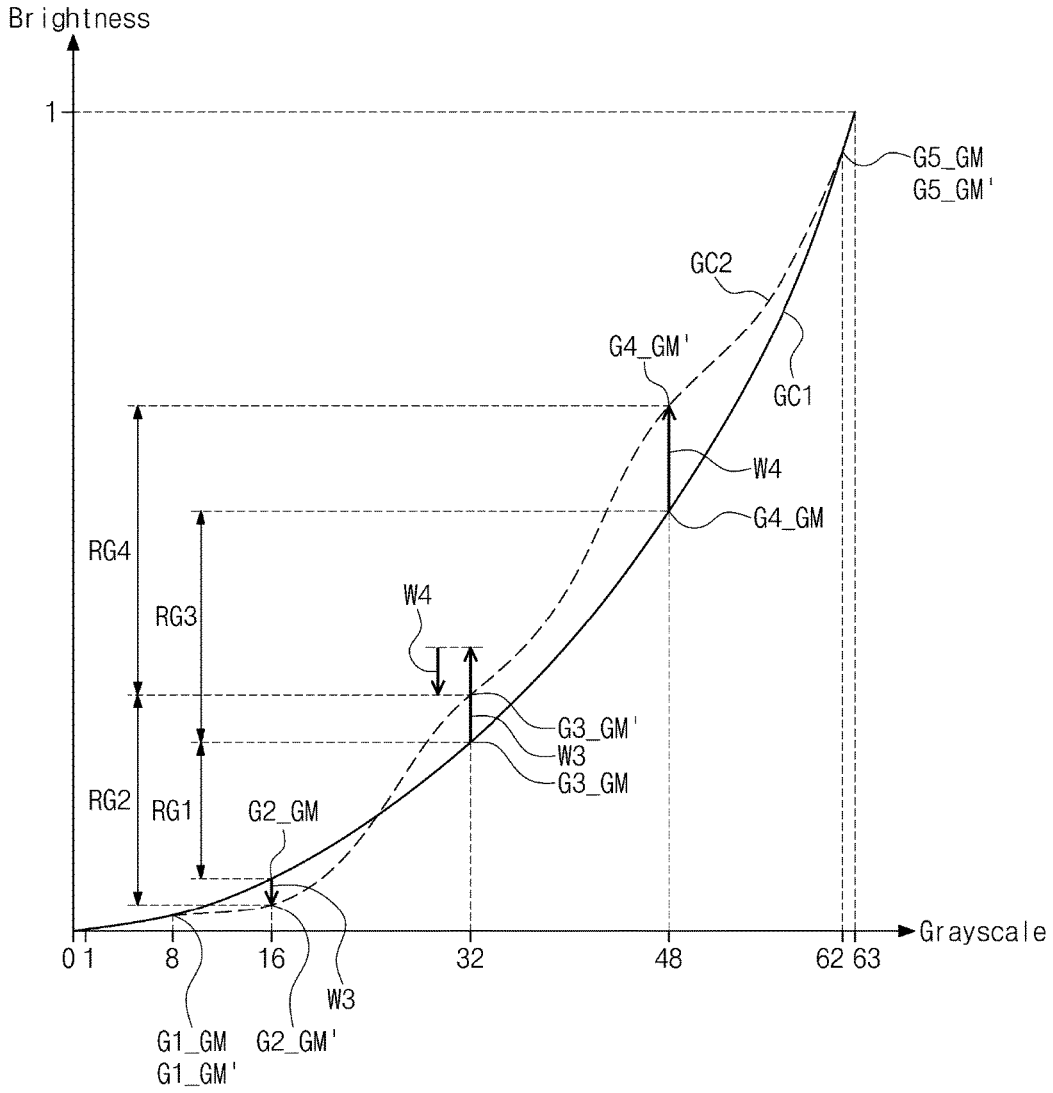
FIG. 13 is a view explaining an operation of a gamma data modulator shown in FIG. 5.

FIG. 5 is a block diagram showing the data processor 530 shown in FIG. 3. FIGS. 6 and 7 are views explaining an operation of a grayscale variation amount calculator 532 shown in FIG. 5. FIGS. 8 to 11 are views explaining an operation of a grayscale variation amount distribution analyzer 533 shown in FIG. 5. FIG. 12 is a view explaining an operation of a distribution ratio analyzer 534 shown in FIG. 5. FIG. 13 is a view explaining an operation of a gamma data modulator 535 shown in FIG. 5.

Referring to FIG. 5, the data processor 530 includes a grayscale analyzer 531, the grayscale variation amount calculator 532, the grayscale variation amount distribution analyzer 533, the distribution ratio analyzer 534, and the gamma data modulator 535. The grayscale analyzer 531 receives the image signals RGB, and the image signals RGB include pixel position information and grayscale values. The pixel position information indicates positions of the pixels PX to which the image signals RGB are applied. The grayscale analyzer 531 analyzes the pixel position information and the grayscale values and applies the analyzed pixel position information and the analyzed grayscale values to the grayscale variation amount calculator 532.

Referring to FIGS. 5, 6, and 7, the grayscale variation amount calculator 532 selects each of the pixels PX as the reference pixel PX_r with reference to the pixel position information. In an exemplary embodiment, the pixel PXij arranged in an i-th row and j-th column may be selected as the reference pixel PX_r, for example. The grayscale variation amount calculator 532 may select a pixel PXi(j+1) disposed at a right side of the reference pixel PX_r as a first comparison pixel PX_c1 and a pixel PX(i+1)j disposed at a lower side of the reference pixel PX_r as a second comparison pixel PX_c2.

Referring back to FIG. 1, the gate driver 200 is disposed at a left side of the display panel 100, and although not shown in drawing figures, the gate signals are provided from the left side of the display panel 100 to a right side of the display panel 100. In addition, the gate signals may be sequentially output from an upper side of the display panel 100 to a lower side of the display panel 100. Accordingly, the pixels PX may be driven from left to right direction and from top to bottom direction, but they should not be limited thereto or thereby. The pixels may be driven in other directions according to the position of the gate driver 200.

The reference pixels PX_r and the first and second comparison pixels PX_c1 and PX_c2 are selected by taking into account the driven direction of the pixels PX in the grayscale variation amount calculator 532. Accordingly, the pixels PX may be sequentially selected as the reference pixel PX_r from the left to right direction and from the top to bottom direction. In addition, the pixel PXi(j+1) disposed at the right side of the reference pixel PX_r is firstly selected as the first comparison pixel PX_c1, and the pixel PX(i+1)j disposed at the lower side of the reference pixel PX_r is next selected as the second comparison pixel PX_c2.

The grayscale variation amount calculator 532 calculates the difference value between the reference grayscale value defined as the grayscale value of the image signal applied to the reference pixel PX_r and a first comparison grayscale value defined as the grayscale value of the image signal applied to the first comparison pixel PX_c1. The grayscale variation amount calculator 532 calculates the difference value between the reference grayscale value and a second comparison grayscale value defined as the grayscale value of the image signal applied to the second comparison pixel PX_c2. For the last pixel (e.g., PXmn), the difference value between the above-mentioned reference grayscale value and the first and second comparison grayscale values is not calculated since there is no comparison pixel.

The reference grayscale values and the grayscale variation amounts, which are calculated by the grayscale variation amount calculator 532 and defined by the difference values between the reference grayscale values and the first and second comparison grayscale values, are provided to the grayscale variation amount distribution analyzer 533.

Figure 8:
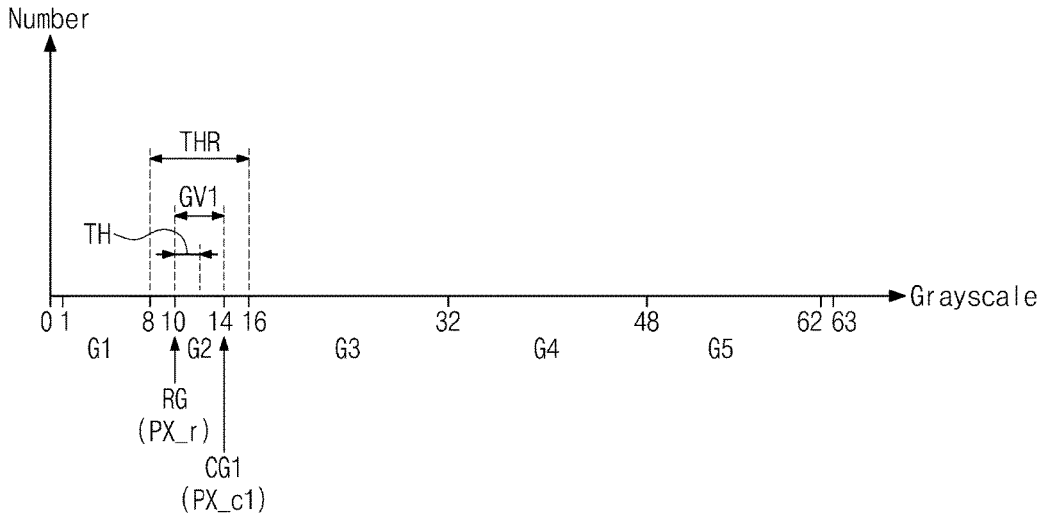
FIGS. 8 to 11 are views explaining an operation of a grayscale variation amount distribution analyzer shown in FIG. 5.
Figure 9:
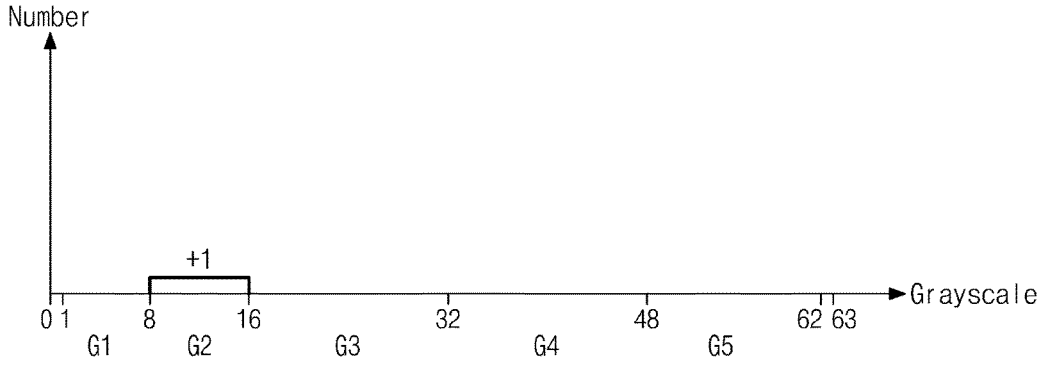

Referring to FIGS. 5, 8, and 9, the grayscale variation amount distribution analyzer 533 classifies the grayscale range, which may be processed by the data driver 300, into the grayscale grades G1 to G5. In an exemplary embodiment, the data driver 300 may have a basic specification of the grayscale range of 0 to 63 to process 64 grayscale values, and in this case, the data driver 300 may output the data voltages corresponding to the grayscale values of 0 to 63, for example.

The grayscale variation amount distribution analyzer 533 may include information on the basic specification of the data driver 300 and classify the grayscale range processed by the data driver 300 except for a maximum grayscale value and a minimum grayscale value into a predetermined number of grades to set the grayscale grades G1 to G5. In an exemplary embodiment, the grayscale values of 1 to 62 except for the 0 grayscale value (0) and the 63 grayscale value (63) may be classified into 5 grayscale grades G1 to G5, for example. Each of the grayscale grades G1 to G5 has a predetermined grayscale range, and the grayscale ranges of the grayscale grades G1 to G5 may be set to be the same as or different from each other.

In an exemplary embodiment, a first grayscale grade G1 has the grayscale range from 1 grayscale value (1) to 8 grayscale value (8), a second grayscale grade G2 has the grayscale range greater than the 8 grayscale value (8) and equal to or smaller than 16 grayscale value (16), a third grayscale grade G3 has the grayscale range greater than the 16 grayscale value (16) and equal to or smaller than 32 grayscale value (32), a fourth grayscale grade G4 has the grayscale range greater than the 32 grayscale value (32) and equal to or smaller than 48 grayscale value (48), and a fifth grayscale grade G5 has the grayscale range greater than the 48 grayscale value (48) and equal to or smaller than 62 grayscale value (62), for example.

The maximum grayscale value and the next greatest grayscale value may not be distinguished and recognized by a user, and for the same reason, the minimum grayscale value and the next smallest grayscale value may not be distinguished and recognized by the user. Accordingly, the maximum grayscale value and the minimum grayscale value may not be included in the grayscale grades G1 to G5.

In the illustrated exemplary embodiment, the 64 grayscale values are classified into 5 grayscale grades as a representative example, but the number of the grayscale grades should not be limited to five. In addition, the data driver 300 processes the 64 grayscale values, but the data driver 300 may process various other grayscale values such as 128 or 256 grayscale values. In this case, the grayscale range of the data driver 300 may be classified into more than five grayscale grades.

The image signals RGB may have a grayscale range different from the grayscale range processed by the data driver 300. In an exemplary embodiment, the image signals RGB may have the grayscale range of 0 to 255 corresponding to 256 grayscale values, for example. In this case, the 256 grayscale values are classified into 64 grayscale ranges, and the grayscale ranges may sequentially correspond to the 64 grayscale values, for example.

In an exemplary embodiment, grayscale values of 0 to 3 among the 256 grayscale values are included in 0 grayscale among the 64 grayscale values, and grayscale values of 4 to 7 among the 256 grayscale values are included in 1 grayscale among the 64 grayscale values, for example. In this way, the 256 grayscale values of the image signals RGB are classified into the 64 grayscale ranges and included in the 64 grayscales of the data driver 300.

Hereinafter, a difference value between a reference grayscale value RG provided to the reference pixel PX_r and a first comparison grayscale value CG1 provided to the first comparison pixel PX_c1 is referred to as a first grayscale variation amount GV1, and a difference value between the reference grayscale value RG and a second comparison grayscale value CG2 provided to the second comparison pixel PX_c2 is referred to as a second grayscale variation amount GV2.

The grayscale variation amount distribution analyzer 533 sets a threshold value TH using the reference grayscale value RG and compares the first grayscale variation amount GV1 to the threshold value TH. The threshold value TH may be set to a predetermined rate with respect to the reference grayscale value RG. In an exemplary embodiment, the threshold value TH may be set to about 20% with respect to the reference grayscale value RG, for example, but it should not be limited thereto or thereby. That is, the threshold value TH may be set to various rates with respect to the reference grayscale value RG.

The grayscale variation amount distribution analyzer 533 counts the value of the grayscale grade to which the reference grayscale value RG belongs among the grayscale grades G1 to G5 when each of the grayscale variation amounts GV1 and GV2 is greater than the threshold value TH and the comparison grayscale values CG1 and CG2 respectively corresponding to the grayscale variation amounts GV1 and GV2 are within the threshold range THR.

The threshold range THR may be defined as the grayscale range of the grayscale grade to which the reference grayscale value RG belongs.

In detail, in a case that the first grayscale variation amount GV1 is greater than the threshold value TH and the first comparison grayscale value CG1 is within the threshold range THR, the value of the grayscale grade to which the reference grayscale value RG belongs is counted up by 1. That is, the first grayscale variation amount GV1 is compared to the threshold value TH, the first comparison grayscale value CG1 is compared to the threshold range THR, and the compared results are counted up to the grayscale grade to which the reference grayscale value RG belongs.

Hereinafter, specific numerical values will be used for the following descriptions as an example to help understanding. In an exemplary embodiment, the reference grayscale value RG may be 10, the threshold value TH may be 2 corresponding to about 20% of the reference grayscale value RG, and the first comparison grayscale value CG1 may be 14, for example. The first grayscale variation amount GV1 is greater than the threshold value TH that is 2 since the first grayscale variation amount GV1 is 4, and the first comparison grayscale value CG1 has a value within the grayscale range of the second grayscale grade G2 to which the reference grayscale value RG belongs. Accordingly, as shown in FIG. 9, the value of the second grayscale grade G2 to which the reference grayscale value RG belongs is counted up by 1.

Figure 10:
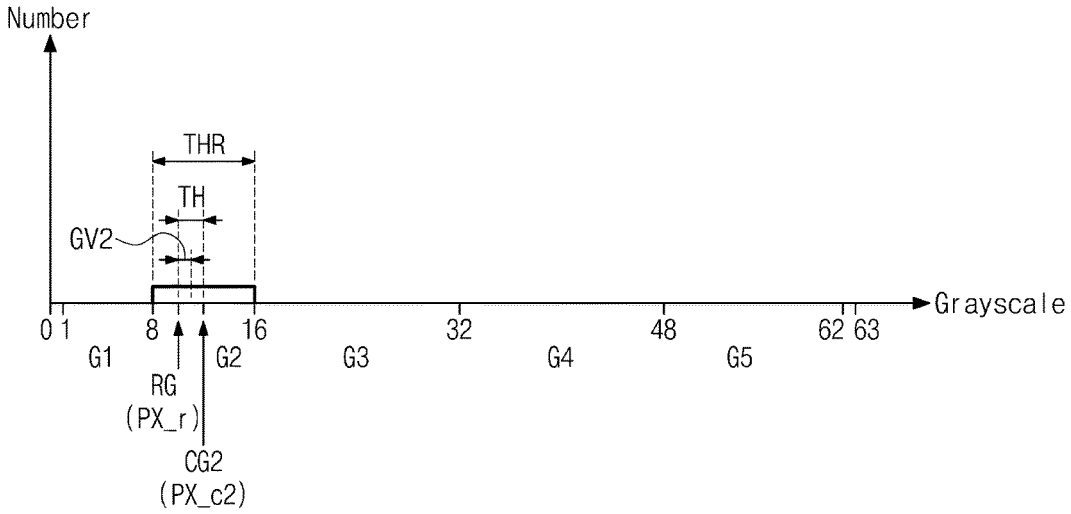

Referring to FIG. 10, the first grayscale variation amount GV1 is compared to the threshold value TH, and then the second grayscale variation amount GV2 is compared to the threshold value TH. In a case that the second grayscale variation amount GV2 is smaller than the threshold value TH, the value of the grayscale grade to which the reference grayscale value RG belongs is not counted up. In addition, although not shown in FIG. 10, in a case that the second grayscale variation amount GV2 is equal to the threshold value TH, the value of the grayscale grade to which the reference grayscale value RG belongs is not counted up. Accordingly, the state of the second grayscale grade G2 counted up by 1 in FIG. 9 is maintained in FIG. 10.

Figure 11:
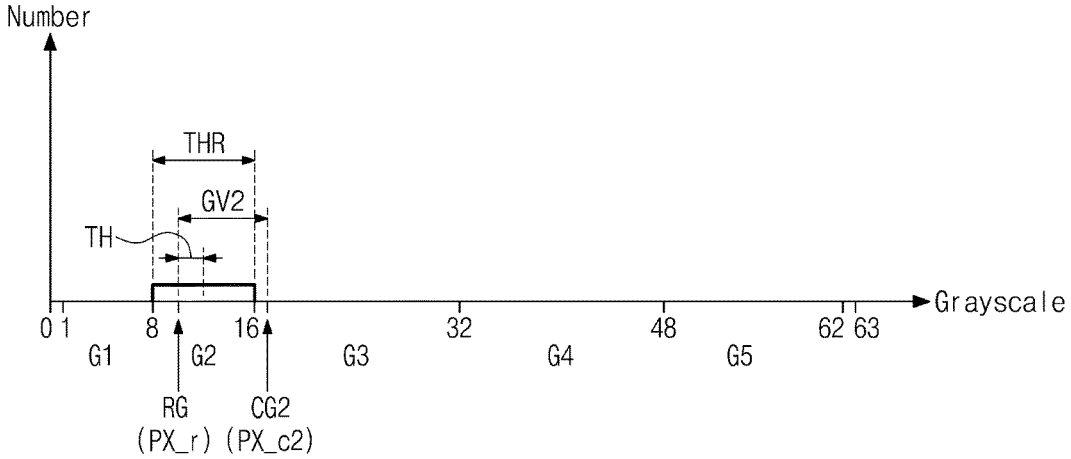

Referring to FIG. 11, although the second grayscale variation amount GV2 is greater than the threshold value TH, the second comparison grayscale value CG2 may not be within the threshold range THR. In the case that the second comparison grayscale value CG2 is out of the threshold range THR, the value of the second grayscale grade G2 to which the reference grayscale value RG belongs is not counted up.

Each of the pixels PX may be set as the reference pixel PX_r, and the above-mentioned operations may be repeatedly performed. Accordingly, the first and second grayscale variation amounts GV1 and GV2 may be compared to the threshold value TH, the first and second comparison grayscale values CG1 and CG2 may be compared to the threshold range THR, and the compared results may be counted up and accumulated in the grayscale grades G1 to G5.

Through the above-mentioned operations, the distribution ratio of the pixels PX each in which the difference between the grayscale value thereof and the grayscale values of the pixels adjacent thereto is greater than the threshold value TH may be checked. The grayscale variation amount distribution analyzer 533 provides the values accumulated in the grayscale grades G1 to G5 to the distribution ratio analyzer 534.

Referring to FIGS. 5 and 12, the distribution ratio analyzer 534 calculates the distribution ratio of the values accumulated in the first to fifth grayscale grades G1 to G5. The ratio of the value accumulated in each grayscale grade to a total value obtained by summing the values accumulated in the first to fifth grayscale grades G1 to G5 is calculated.

In an exemplary embodiment, the value accumulated in the third grayscale grade G3 is about 55% with respect to the total value, the value accumulated in the fourth grayscale grade G4 is about 30% with respect to the total value, the value accumulated in the second grayscale grade G2 is about 7.5% with respect to the total value, the value accumulated in the first grayscale grade G1 is about 5% with respect to the total value, and the value accumulated in the fifth grayscale grade G5 is about 2.5% with respect to the total value. Through the above-mentioned operations, the distribution ratio of the pixels PX each in which the difference between the grayscale value thereof and the grayscale values of the pixels adjacent thereto is greater than the threshold value TH may be checked, for example.

The values shown in FIG. 12 are merely illustrative examples, and the value accumulated in each of the first to fifth grayscale grades G1 to G5 may have various ratios depending on the grayscale values of the pixels PX. The distribution ratios of the values accumulated in the first to fifth grayscale grades G1 to G5, which are calculated by the distribution ratio analyzer 534, are provided to the gamma data modulator 535.

Referring to FIGS. 5 and 13, the gamma data modulator 535 applies the weight to the first to fifth grayscale grades G1 to G5 depending on the distribution ratios of the values accumulated in the first to fifth grayscale grades G1 to G5 and varies the gamma data GMD to extend the gamma data GMD corresponding to the grayscale grades to which the weight is applied.

In an exemplary embodiment, the weight W is determined depending on the distribution ratios of the values accumulated in the first to fifth grayscale grades G1 to G5, for example. The weight W is set differently depending on the distribution ratio of the grayscale grades, and the weight increases as the distribution ratio increases. In an exemplary embodiment, the weight W may be set as shown in Table 1 below, for example.

TABLE 1

| Distribution ratio of k-th grayscale grade (Gk) | Weight (W) |
|---|---|
| Gk ≤ 12.5% | W = 0.0% |
| 12.5% < Gk ≤ 25.0% | W = 12.5% |
| 25.0% < Gk ≤ 37.5% | W = 25.0% |
| 37.5% < Gk ≤ 50.0% | W = 37.5% |
| 50.0% < Gk ≤ 62.5% | W = 50.0% |
| 62.5% < Gk ≤ 75.0% | W = 62.5% |
| 87.5% < Gk | W = 87.5% |

Table 1 shows the weight depending on seven distribution ratios, but the number of the distribution ratios and the weight may be set to various values different from those in Table 1. Referring to Table 1, in the case that the distribution ratios of the first to fifth grayscale grades G1 to G5 is greater than the threshold ratio, the weight may be applied to the first to fifth grayscale grades G1 to G5. In addition, the weight W may be set differently depending on the distribution ratio, and the weight W may increase as the distribution ratio increases.

In an exemplary embodiment, the threshold ratio is set to about 12.5%, for example, and the weight W may be applied to the third and fourth grayscale grades G3 and G4 having the distribution ratio greater than the threshold ratio. Since the distribution ratio of the third grayscale grade G3 is about 30%, the weight W of the third grayscale grade G3 is determined as about 25%, and since the distribution ratio of the fourth grayscale grade G4 is about 55%, the weight W of the fourth grayscale grade G4 is determined as about 50%. The weight W of each of the first, second, and fifth grayscale grades G1, G2, and G5 is determined as 0%.

A k-th reference gamma data Gk_GM defined as the gamma data corresponding to the maximum grayscale value of the k-th grayscale grade Gk may vary according to the weight W, and k-th modulation gamma data Gk_GM' defined as the gamma data obtained by varying the k-th reference gamma data Gk_GM may be determined by the following Equation 1.

$$Gk_{13}\ GM'=(Gk_GM+(Gk_GM\times Wk))-(Gk_GM\times W(k+1)) \quad \text{<Equation 1>}$$

In Equation 1, Wk denotes a k-th weight applied to the k-th grayscale grade Gk, and W(k+1) denotes a (k+1)th weight applied to a (k+1)th grayscale grade. Here, k is a natural number.

FIG. 13 is a view showing the gamma curves GC1 and GC2 as a function of the grayscale values of the image signals RGB, and the grayscale values of the image signals RGB are displayed after being converted to the grayscale values of 0 to 63 within the grayscale range of the data driver 300. The gamma curves GC1 and GC2 represent the grayscale values of the image signals and the brightness values corresponding to the grayscale values.

The grayscale values are input values, and the brightness values are defined as output values determined depending on the input values. The brightness values substantially correspond to the gamma data, and hereinafter, an operation of the gamma data modulator 535 will be described by applying the gamma data to the gamma curves GC1 and GC2.

A second weight W2 of the second grayscale grade G2 is about 0%, and a third weight W3 of the third grayscale grade G3 is about 50%. Accordingly, second modulation gamma data G2_GM' may be determined as a value obtained by subtracting a value obtained by multiplying the second reference gamma data G2_GM by the third weight W3 from the second reference gamma data G2_GM.

The third weight W3 of the third grayscale grade G3 is about 50%, and a fourth weight W4 of the fourth grayscale grade G4 is about 25%. Accordingly, third modulation gamma data G3_GM' may be determined as a value obtained by adding a value obtained by multiplying third reference gamma data G3_GM by the third weight W3 to the third reference gamma data G3_GM and subtracting a value obtained by multiplying the third reference gamma data G3_GM by the fourth weight W4 from the added value.

The fourth weight W4 of the fourth grayscale grade G4 is about 25%, and a fifth weight W5 of the fifth grayscale grade G5 is about 0%. Accordingly, fourth modulation gamma data G4_GM' may be determined as a value obtained by adding a value obtained by multiplying fourth reference gamma data G4_GM by the fourth weight W4 to the fourth reference gamma data G4_GM.

Since first reference gamma data G1_GM and fifth reference gamma data G5_GM do not vary, first modulation gamma data G1_GM' is substantially the same as the first reference gamma data G1_GM, and fifth modulation gamma data G5_GM' is substantially the same as the fifth reference gamma data G5_GM.

In the k-th grayscale grade Gk, the gamma data GMD except for the k-th modulation gamma data Gk_Gm' may be determined to have values between (k−1)th modulation gamma data and the k-th modulation gamma data Gk_GM'. In an exemplary embodiment, the gamma data GMD corresponding to the grayscale values between 16 grayscale and 32 grayscale may have values between the second modulation gamma data G2_GM' and the third modulation gamma data G3_GM', for example.

In a case that the weight W is not applied to the first to fifth grayscale grades G1 to G5, the gamma curve may have the first gamma curve GC1, but in a case that the weight W is applied to the first to fifth grayscale grades G1 to G5, the gamma curve may vary as the second gamma curve GC2. The first gamma curve GC1 may substantially be a third graph GP3 shown in FIG. 4.

In the case that the gamma curve varies from the first gamma curve GC1 to the second gamma curve GC2, the gamma data corresponding to predetermined grayscale values may extend. In the exemplary embodiment of the invention, the weight W is applied to the gamma data GMD corresponding to the third and fourth grayscale grades G3 and G4, for example.

The range of the gamma data corresponding to 16 to 32 grayscale values has a first range RG1 on the first gamma curve GC1, however, the range of the gamma data corresponding to 16 to 32 grayscale values extends to a second range RG2 greater than the first range RG1 on the second gamma curve GC2. In addition, the range of the gamma data corresponding to 32 to 48 grayscale values has a third range RG3 on the first gamma curve GC1, however, the range of the gamma data corresponding to 32 to 48 grayscale values extends to a fourth range RG4 greater than the third range RG3 on the second gamma curve GC2. Accordingly, the range of the gamma data GMD corresponding to the third and fourth grayscale grades G3 and G4 to which the weight W is applied may extend.

The gamma voltages VGM are generated by the gamma data GMD, the data voltages are generated by the gamma voltages VGM, and the brightness values of the pixels PX correspond to the data voltages. In a case that the gamma voltages VGM extend in the same grayscale range, the brightness values may extend, and thus a difference between a minimum brightness and a maximum brightness may increase. As the difference between the minimum brightness and the maximum brightness increases, the contrast ratio increases, and thus the image may be displayed more clearly.

In the case that the distribution ratio of the pixels PX each in which the difference between the grayscale value thereof and the grayscale values of the pixels adjacent thereto is greater than the threshold value is greater than a predetermined threshold ratio, the brightness values may extend such that the contrast ratio increases in areas in which such pixels PX are arranged.

Consequently, the display apparatus 600 according to the exemplary embodiment of the invention may improve the contrast ratio, and thus the display quality may be improved.

Figure 14:
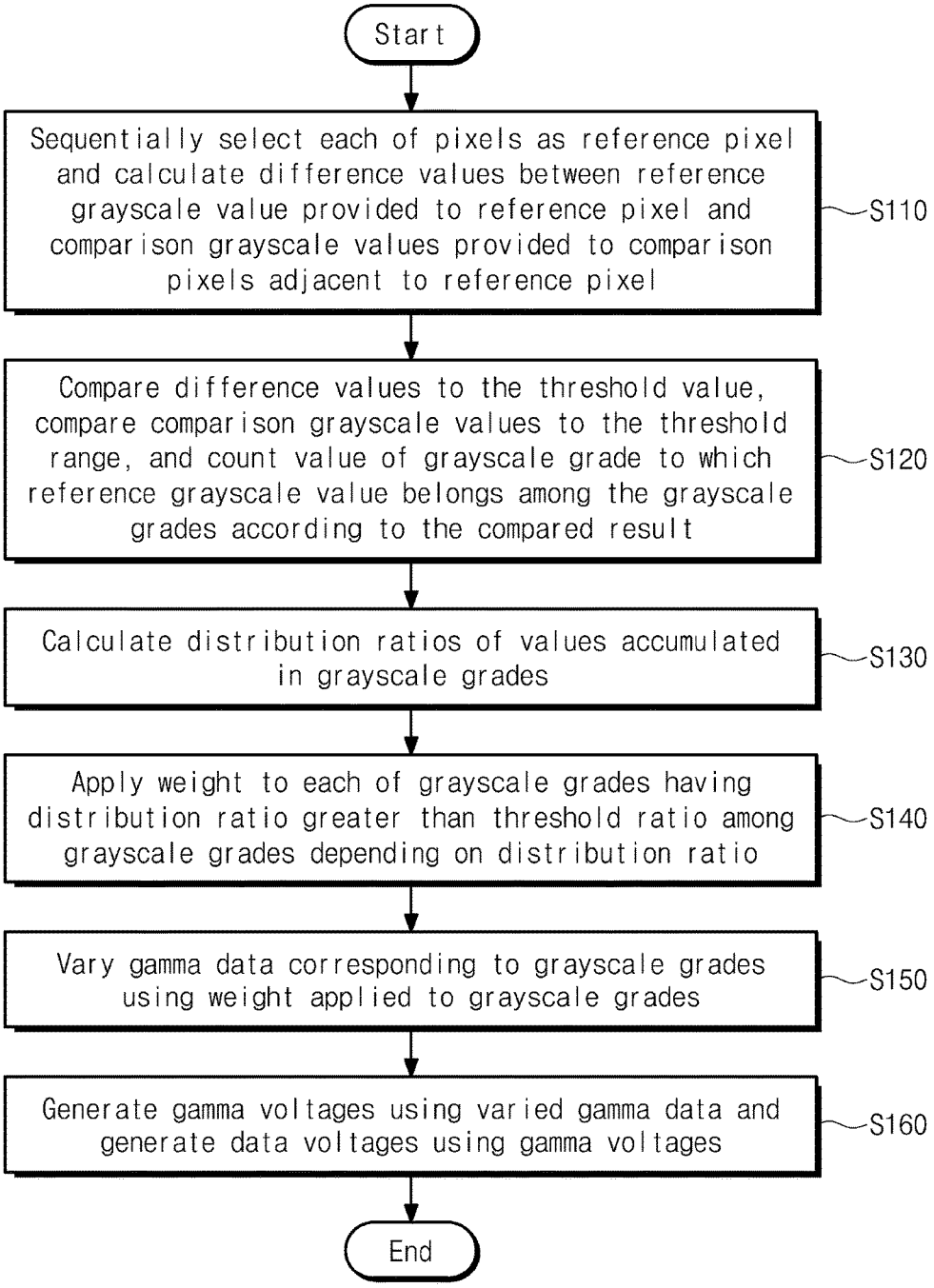
FIG. 14 is a flowchart explaining an exemplary embodiment of a method of driving a display apparatus according to the invention.
Figure 15:
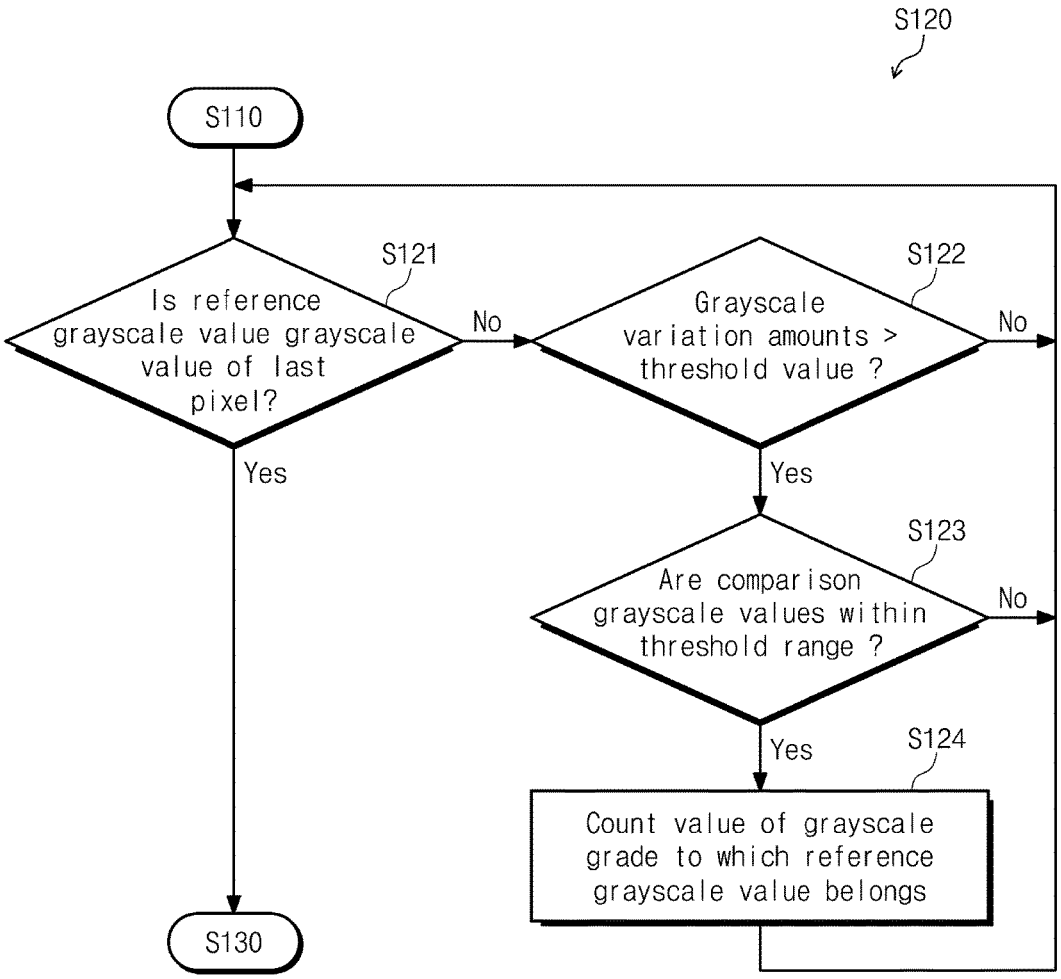
FIG. 15 is a flowchart explaining a method of accumulating compared results shown in FIG. 14 in grayscale grades.
Figure 16:
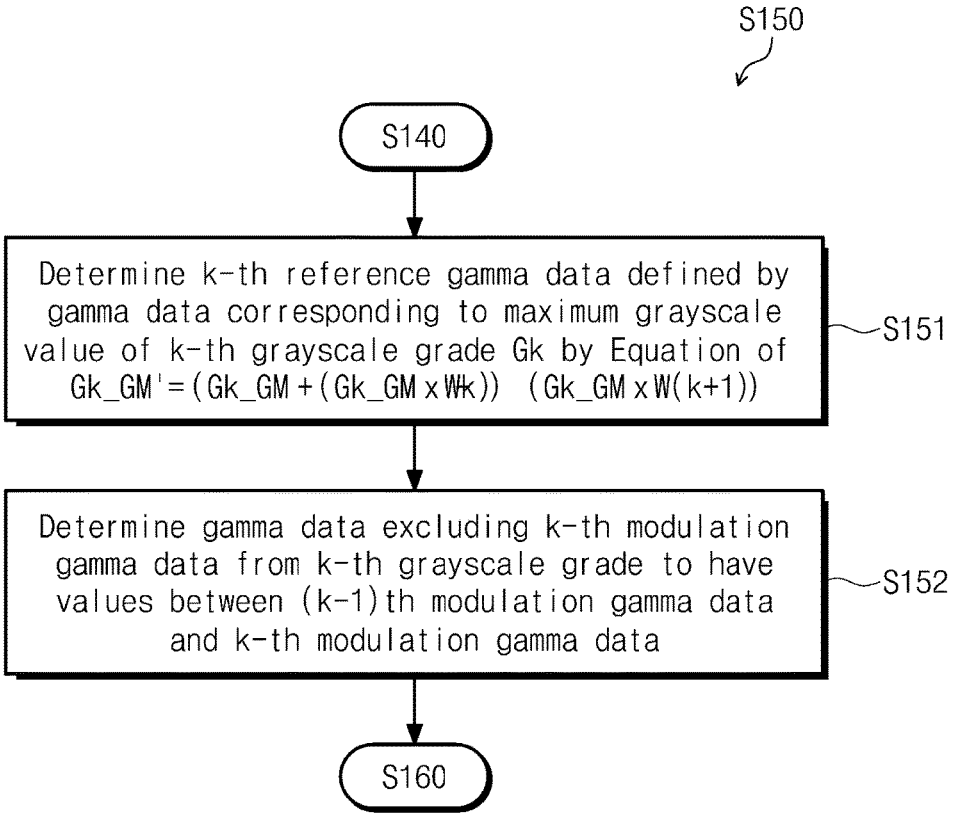
FIG. 16 is a flowchart explaining a method of modulating gamma data shown in FIG. 14.

FIG. 14 is a flowchart explaining a method of driving a display apparatus according to an exemplary embodiment of the invention. FIG. 15 is a flowchart explaining a method of accumulating compared results shown in FIG. 14 in grayscale grades. FIG. 16 is a flowchart explaining a method of modulating gamma data shown in FIG. 14.

Referring to FIGS. 14, 15, and 16, in operation S110, each of the pixels PX is sequentially selected as the reference pixel PX_r (refer to FIG. 6), and the difference values between the reference grayscale value RG (refer to FIGS. 8, 10 and 11) provided to the reference pixel PX_r and the comparison grayscale values CG1 and CG2 (refer to FIGS.

8, 10 and 11) provided to the comparison pixels PX_c1 (refer to FIG. 6) and PX_c2 (refer to FIG. 6) adjacent to the reference pixel PX_r are calculated. As described above, the difference value between the reference grayscale value RG and the first comparison grayscale value CG1 is calculated, and the difference value between the reference grayscale value RG and the second comparison grayscale value CG2 is calculated.

In operation S120, the difference values between the reference grayscale value RG and the comparison grayscale values CG1 and CG2 are compared to the threshold value TH (refer to FIGS. 8, 10 and 11), the comparison grayscale values CG1 and CG2 are compared to the threshold range THR (refer to FIGS. 8, 10 and 11), and the value of the grayscale grade to which the reference grayscale value RG belongs among the grayscale grades G1 to G5 (refer to FIGS. 8 to 12) is counted up according to the compared result.

In detail, in operation S121, it is checked whether the reference grayscale value RG is a reference grayscale value of the last pixel. The difference values between the reference grayscale value RG and the comparison grayscale values CG1 and CG2 may be calculated each time the reference pixel PX_r is selected in operation S110, but in the case that the reference grayscale value RG is the reference grayscale value of the last pixel, the difference values are not calculated since there is no comparison pixel. Accordingly, when it is checked that the reference grayscale value RG is the reference grayscale value of the last pixel in operation S121, the process proceeds to operation S130.

In the case that the reference grayscale value RG is not the reference grayscale value of the last pixel, it is checked whether the grayscale variation amounts GV1 (refer to FIG. 8) and GV2 (refer to FIG. 10) defined by the difference between the reference grayscale value RG corresponding to one reference pixel PX_r and the comparison grayscale values CG1 and CG2 are greater than the threshold value TH in operation S122. As described above, the grayscale variation amounts GV1 and GV2 include the first grayscale variation amount GV1 and the second grayscale variation amount GV2.

In the case that the grayscale variation amounts GV1 and GV2 are greater than the threshold value TH, it is checked whether the comparison grayscale values CG1 and CG2 are within the threshold range THR in operation S123. In the case that the comparison grayscale values CG1 and CG2 are within the threshold range THR, the value of the grayscale grade to which the reference grayscale value belongs is counted up in operation S124, and then the process proceeds to operation S121.

The value of the grayscale grade is counted up with respect to each of the first grayscale variation amount GV1 and the second grayscale variation amount GV2. That is, when each of the grayscale variation amounts GV1 and GV2 is greater than the threshold value TH and the comparison grayscale values CG1 and CG2 respectively corresponding to the grayscale variation amounts GV1 and GV2 are within in the threshold range THR, the value of the grayscale grade to which the reference grayscale value RG belongs among the grayscale grades G1 to G5 is counted up.

In operation S122, in the case that the grayscale variation amounts GV1 and GV2 are equal to or smaller than the threshold value TH, the process proceeds to operation S121. In operation S123, in the case that the comparison grayscale values CG1 and CG2 are not within the threshold range THR, the process proceeds to operation S121.

In operation S130, the distribution ratios of the values accumulated in the grayscale grades G1 to G5 are calculated. In operation S140, the weight W is applied to each of the grayscale grades having the distribution ratio greater than the threshold ratio among the grayscale grades G1 to G5 depending on the distribution ratio. As the distribution ratio increases, the weight W increases.

In operation S150, the gamma data GMD vary using the weight W applied to the grayscale grades such that the gamma data GMD corresponding to the grayscale grades to which the weight W is applied extend.

In detail, in operation S151, the k-th reference gamma data Gk_GM defined by the gamma data corresponding to the maximum grayscale value of the k-th grayscale grade Gk is determined by Equation of Gk_GM'=(Gk_GM+(Gk_GM×Wk))−(Gk_GM×W(k+1)). Then, in operation S152, the gamma data excluding the k-th modulation gamma data Gk_GM' of the k-th grayscale grade Gk are determined to have the values between the (k−1)th modulation gamma data and the k-th modulation gamma data Gk_GM', and the process proceeds to operation S160.

In operation S160, the gamma voltages VGM are generated using the varied gamma data GMD, and the data voltages are generated by the gamma voltages VGM. The data voltages are provided to the pixels PX, and the pixels PX are driven by the data voltages to display the image.

Through the above-mentioned operations, the gamma voltages VGM extend in the same grayscale range, and the brightness values may extend. Since the difference between the minimum brightness and the maximum brightness increases, the contrast ratio increases, and thus the image may be displayed more clearly.

Although the exemplary embodiments of the invention have been described, it is understood that the invention should not be limited to these exemplary embodiments but various changes and modifications can be made by one ordinary skilled in the art within the spirit and scope of the invention as hereinafter claimed. Therefore, the disclosed subject matter should not be limited to any single embodiment described herein, and the scope of the invention shall be determined according to the attached claims.

What is claimed is:

1. A display apparatus comprising:

a plurality of pixels which receives a plurality of data voltages in response to a plurality of gate signals;

a data processor which generates a plurality of gamma data;

a gamma voltage generator which generates a plurality of gamma voltages using the plurality of gamma data; and a data driver which generates the plurality of data voltages using the plurality of gamma voltages and applies the plurality of data voltages to the plurality of pixels, wherein the data processor sequentially selects each of the plurality of pixels as a reference pixel, calculates difference values between a reference grayscale value provided to the reference pixel and comparison grayscale values provided to comparison pixels adjacent to the reference pixel, compares the difference values to a threshold value, counts up a value of a grayscale grade to which the reference grayscale value belongs among a plurality of grayscale grades according to the compared result, and varies the plurality of gamma data based on distribution ratios of values accumulated in the plurality of grayscale grades.

2. The display apparatus of claim 1, wherein the comparison pixels comprise:

a first comparison pixel adjacent to a right side of the reference pixel; and a second comparison pixel disposed at a lower side of the reference pixel.

3. The display apparatus of claim 1, wherein the data processor comprises:

a grayscale variation amount calculator which calculates the difference values between the reference grayscale value and the comparison grayscale values;

a grayscale variation amount distribution analyzer which compares grayscale variation amounts defined by the difference values to the threshold value, compares the comparison grayscale values to a threshold range, and counts up the value of the grayscale grade to which the reference grayscale value belongs according to the compared result;

a distribution ratio analyzer which calculates the distribution ratios of the values accumulated in the plurality of grayscale grades; and a gamma data modulator which varies the plurality of gamma data based on the distribution ratios of the values accumulated in the plurality of grayscale grades.

4. The display apparatus of claim 3, wherein the grayscale variation amount distribution analyzer counts up the value of the grayscale grade to which the reference grayscale value belongs when each of the grayscale variation amounts is greater than the threshold value and the comparison grayscale values respectively corresponding to the grayscale variation amounts are values within the threshold range.

5. The display apparatus of claim 4, wherein the threshold value is set to a predetermined ratio of the reference grayscale value.

6. The display apparatus of claim 4, wherein the grayscale variation amount distribution analyzer divides a grayscale range excluding a maximum grayscale value and a minimum grayscale value of a grayscale range of the data driver into a plurality of grades to set the plurality of grayscale grades.

7. The display apparatus of claim 4, wherein the threshold range is set to a grayscale range of the grayscale grade to which the reference grayscale value belongs.

8. The display apparatus of claim 4, wherein the distribution ratio analyzer calculates a ratio of the value accumulated in each of the grayscale grade to a total value obtained by summing the values accumulated in the plurality of grayscale grades.

9. The display apparatus of claim 4, wherein the gamma data modulator applies a weight to grayscale grades of the plurality of grayscale grades having the distribution ratio greater than the threshold ratio among the plurality of grayscale grades.

10. The display apparatus of claim 9, wherein the weight increases as the distribution ratio increases.

11. The display apparatus of claim 9, wherein k-th reference gamma data defined by gamma data corresponding to a maximum grayscale value of a k-th grayscale grade vary depending on the weight, and k-th modulation gamma data defined by the gamma data obtained by varying the k-th reference gamma data are determined by a following Equation:

$$Gk_GM'=(Gk_GM+(Gk_GM\times Wk))-(Gk_GM\times W(k+1)),$$

where Gk_GM' denotes the k-th modulation gamma data, Gk_GM denotes the k-th reference gamma data, Wk denotes a k-th weight applied to the k-th grayscale grade, W(k+1) denotes a (k+1)th weight applied to a (k+1)th grayscale grade, and k is a natural number.

12. The display apparatus of claim 11, wherein the gamma data of the k-th grayscale grade excluding the k-th modulation gamma data are determined to have values between (k−1)th modulation gamma data obtained by varying the gamma data corresponding to a maximum grayscale value of a (k−1)th grayscale grade and the k-th modulation gamma data.

13. A method of driving a display apparatus, the method comprising:

sequentially selecting each of a plurality of pixels as a reference pixel to calculate difference values between a reference grayscale value provided to the reference pixel and comparison grayscale values provided to comparison pixels adjacent to the reference pixel;

comparing the difference values to a threshold value and comparing the comparison grayscale values to a threshold range to count up a value of a grayscale grade to which the reference grayscale value belongs among a plurality of grayscale grades according to the compared result;

calculating distribution ratios of values accumulated in the plurality of grayscale grades;

varying a plurality of gamma data based on the distribution ratios of the values accumulated in the plurality of grayscale grades;

generating a plurality of gamma voltages using the plurality of varied gamma data; and generating a plurality of data voltages using the plurality of gamma voltages to provide the plurality of data voltages to the plurality of pixels.

14. The method of claim 13, wherein the counting up of the value of the grayscale grade comprises:

comparing each of grayscale variation amounts defined by the difference values to the threshold value;

comparing the comparison grayscale values respectively corresponding to the grayscale variation amounts to the threshold range when each of the grayscale variation amounts is greater than the threshold value; and counting up the value of the grayscale grade to which the reference grayscale value belongs when the corresponding comparison grayscale values are values in the threshold range.

15. The method of claim 14, wherein the threshold value is set to a predetermined ratio of the reference grayscale value, the plurality of grayscale grades are set by dividing a grayscale range excluding a maximum grayscale value and a minimum grayscale value of a grayscale range of the data driver generating the plurality of data voltages into a plurality of grades, and the threshold range is set to a grayscale range of the plurality of grayscale grade to which the reference grayscale value belongs.

16. The method of claim 13, wherein the calculating of the distribution ratios are calculated by a ratio of the value accumulated in each of the grayscale grade to a total value obtained by summing the values accumulated in the plurality of grayscale grades.

17. The method of claim 13, wherein the varying of the plurality of gamma data comprises:

applying a weight to grayscale grades of the plurality of grayscale grades having the distribution ratio greater than a threshold ratio among the plurality of grayscale grades; and varying k-th reference gamma data defined by gamma data corresponding to a maximum grayscale value of a k-th grayscale grade depending on the weight.

18. The method of claim 17, wherein the weight increases as the distribution ratio increases.

19. The method of claim 17, wherein the k-th reference gamma data defined by gamma data corresponding to the maximum grayscale value of the k-th grayscale grade vary depending on the weight, and k-th modulation gamma data defined by the gamma data obtained by varying the k-th reference gamma data are determined by a following Equation:

$$Gk_GM'=(Gk_GM+(Gk_GM\times Wk))-(Gk_GM\times W(k+1)),$$

where Gk_GM' denotes the k-th modulation gamma data, Gk_GM denotes the k-th reference gamma data, Wk denotes a k-th weight applied to the k-th grayscale grade, W(k+1) denotes a (k+1)th weight applied to a (k+1)th grayscale grade, and k is a natural number.

20. The method of claim 19, wherein the gamma data of the k-th grayscale grade excluding the k-th modulation gamma data are determined to have values between (k−1)th modulation gamma data obtained by varying the gamma data corresponding to a maximum grayscale value of a (k−1)th grayscale grade and the k-th modulation gamma data.

* * * * *